United States Patent [19]

Wang

[11] 4,193,214

[45] Mar. 18, 1980

[54] CHANGEABLE SANDAL

[76] Inventor: Chin-Yuan Wang, No. 15, Hsi-An Rd., Pu-Li Town, Nan Tou, Taiwan, 545

[21] Appl. No.: 855,437

[22] Filed: Nov. 28, 1977

[51] Int. Cl.[2] ..... A43B 3/12; A43B 3/24

[52] U.S. Cl. ..... 36/11.5; 36/100; 36/101

[58] Field of Search ..... 36/11.5, 100, 101

[56] References Cited

U.S. PATENT DOCUMENTS

| | | | |
|---|---|---|---|
| 2,367,232 | 1/1945 | Marx | 36/101 X |
| 2,468,863 | 5/1949 | Burns | 36/11.5 |
| 2,761,224 | 9/1956 | Gardiner | 36/101 X |
| 3,000,116 | 9/1961 | Ally | 36/101 |
| 3,902,259 | 9/1975 | Cracco | 36/11.5 |

*Primary Examiner*—James Kee Chi

*Attorney, Agent, or Firm*—Cushman, Darby & Cushman

[57] ABSTRACT

Disclosed here is a novelly designed sandal whose vamp or sole can be changed. If there are many so designed vamps and soles, then many times new sandals can be composed by the interchange among the vamps and soles. For example, 5 different pairs of vamps and 2 different pairs of soles, then 10 different pairs of sandals can be made. The sandal can also be further changed by changing the binding, welt or side element with different color, type, etc.

6 Claims, 10 Drawing Figures

CHANGEABLE SANDAL

BRIEF SUMMARY OF THE INVENTION

It relates to a new kind of sandal. It's vamp is inserted into the specially-made sole by L-shaped angles. The vamp can be firmly fastened up the sole as the binding, welt or side element is drawn tightly and fixed by two screws. The vamp can also be taken off and changed by another vamp when the binding, welt or side element is loosened. The above-mentioned vamp, sole and binding, welt or side element are invented by the applicant, Chin-Yuan Wang.

DETAILED DESCRIPTION

Figure 1:
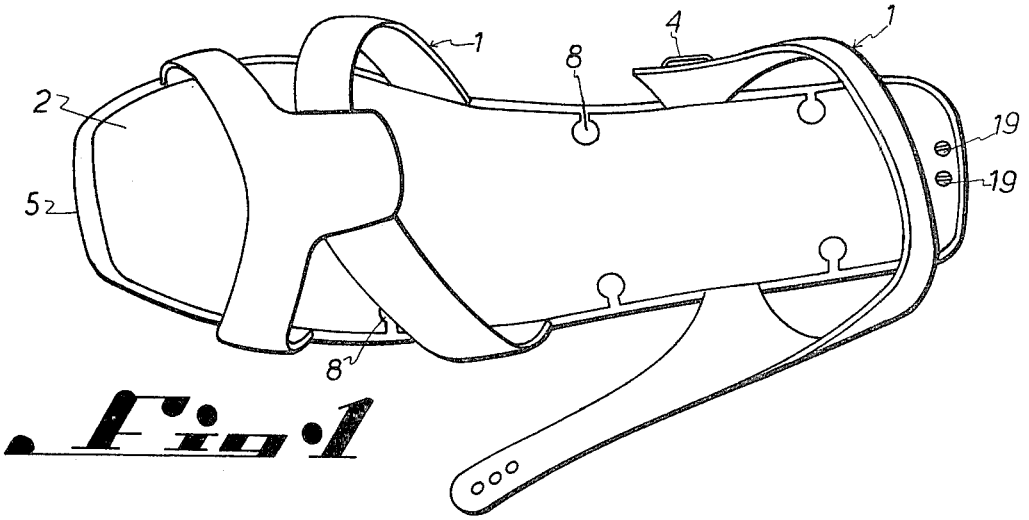
FIG. 1 is a schematic illustration depicting the structural parts of an embodiment of the present invention.

The vamp 1, as shown in FIG. 1, can be any type as desired, but it is fastened on the sole 2 in a completely different way. As in the usual way, the vamp 1 is fastened on the sole 2 firmly and can not be separated from the sole 2 again unless it is destroyed. However in the present invention, an L-shaped angle 3 is applied. It can be made as one piece with the vamp 1 as the vamp 1 is made of plastic or the like. It can also be a metal angle and sewed on the vamp 1 as the vamp 1 is made of leather or the like, as shown in FIGS. 2, 3, 4 and 8.

Figure 2:
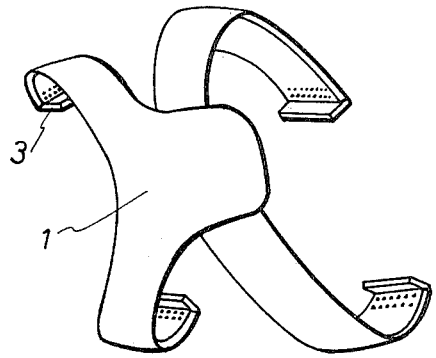
FIG. 2 is the front part of the vamp with the L-shaped angles.
Figure 3:
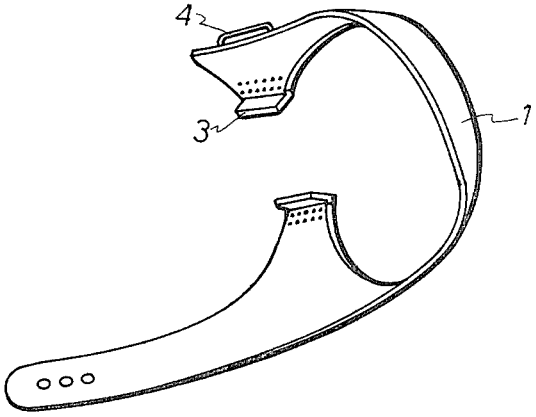
FIG. 3 is the rear part of the vamp with the L-shaped angles.

The front part and rear part of the vamp 1 can be separately made as usual, as shown in FIGS. 2 and 3 respectively. Numeral 4 designates a usual shoe buckle, as shown in FIGS. 1 and 3.

Figure 5:
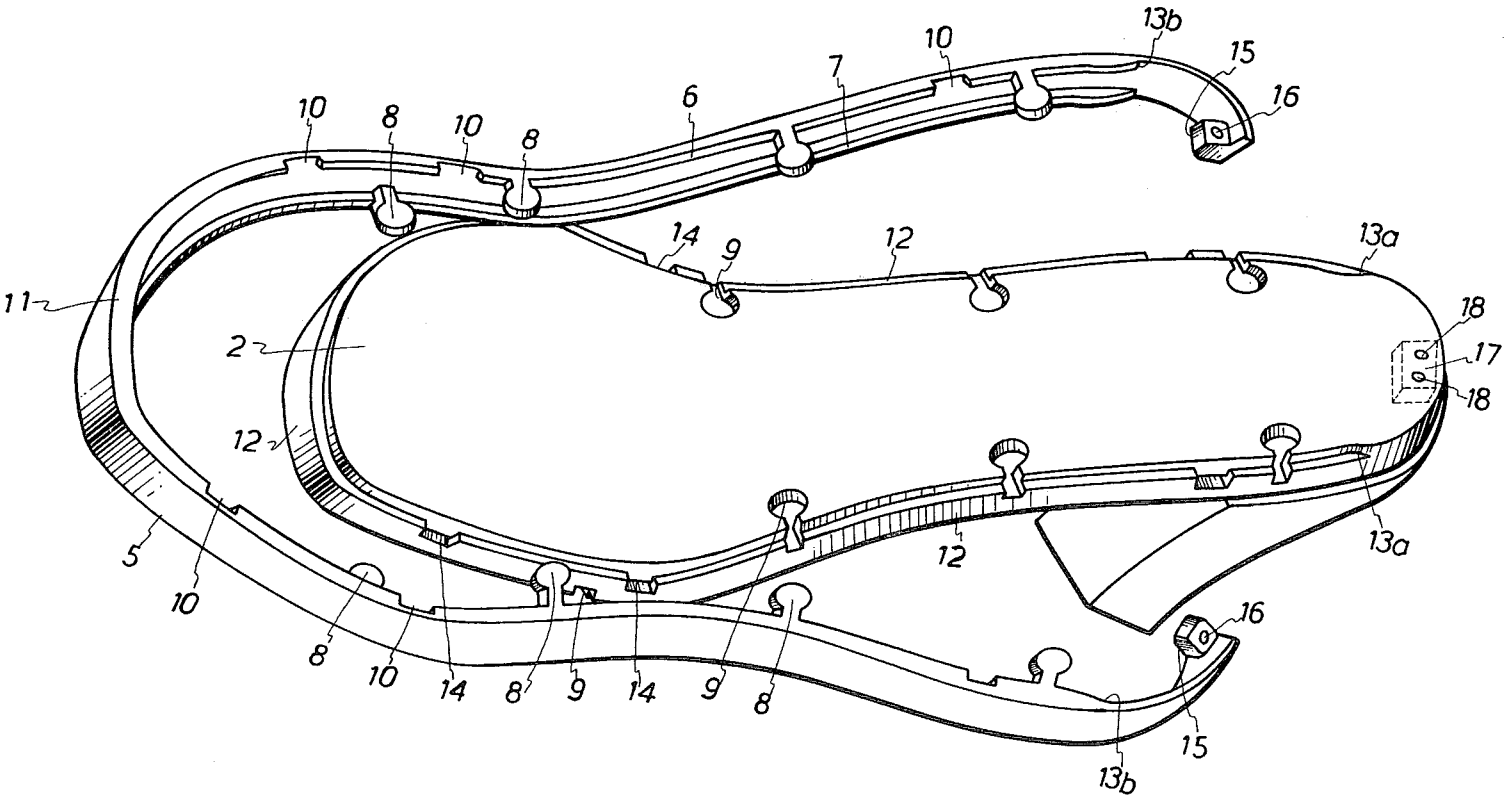
FIG. 5 is a perspective view of an embodiment of the present invention showing the structural parts of the binding, welt or said element and the sole in details.
Figure 6:
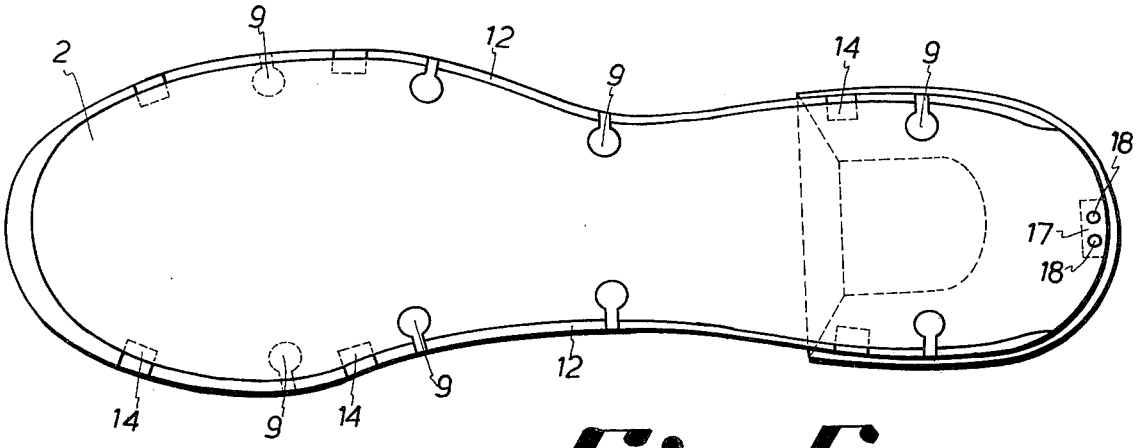
FIG. 6 is the top view of the sole showing the fastening-cuts, the angle-caves, block-cave and the protruded stripe on the sole.

The detailed design of a preferred embodiment of the present invention is shown in FIG. 5. A binding, welt or side element 5 around the shoe side is employed. The binding web, or side element 5 is suitable monolithic. The binding, welt or side element 5 has upper protruded stripe 6 and lower protruded stripe 7. There are several fasteners 8. In the embodiment as shown in FIG. 5, there are six fasteners along the upper protruded stripe 6 on the binding, welt or side element 5 and two fasteners on the lower stripe 7 on the binding, welt or side element 5. The two lower fasteners are thicker than the upper fasteners and are located at the position where the sole 2 is bent during walking. The shape of the circular fasteners 8 are used. There are cut-out fastening regions (fastening-cuts) 9 on the soles. The number, shape and position of the fastening-cuts 9 must match with those of the fasteners, as shown in FIG. 6. There are several angular indentations (angle cuts) 10 on the binding, welt or side element 5 designed for L-shaped angles on the vamp 1.

The thickness of the binding, welt or side element 5 at the front part of the sandal is bigger than that of the other parts of the binding, welt or side element 5, as designated by 11. It can keep the binding, welt or side element 5 fastened firmly around the sole 2 when it hits against some hard things, such as rocks, etc.

Figure 10:
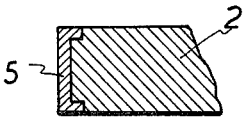
FIG. 10 is showing how the shoelace contacting with the sole side.

There is a protruded stripe 12 at the middle part of the sole side as shown in FIG. 10. The protruded stripes 6 and 7 on the binding, welt or side element 5 end at 13*b*, so the rear part of the binding, welt or side element can be easily bent. The protruded stripe 12 on the shoe side ends at 13*a*. When the protruded stripes 6, 7 and 12 are fastened up together, 13*a* and 13*b* can be met together, too. Since the distance between the upper and lower protruded stripes 6 and 7 on the binding, welt or side element 5 is equal to the height of the protruded stripe 12 on the sole side.

Figure 7:
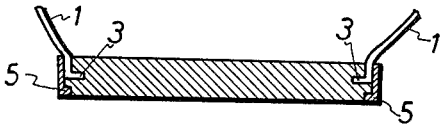
FIG. 7 is a sectional view of FIG. 6, but with the shoelace on showing how the L-shaped angles functioned.
Figure 8:
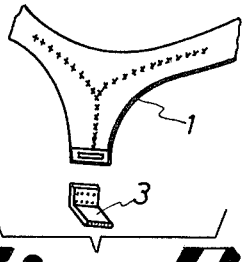
FIG. 8 shows the metal L-shaped angle being fastened up the leather vamp by some suitable means.
Figure 7A:
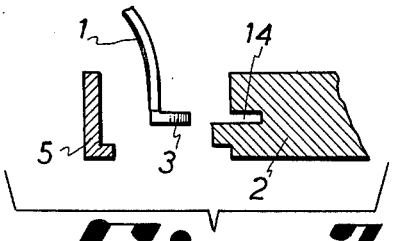
FIG. 7A shows the L-shaped angle assembly.
Figure 7B:
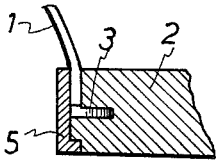
FIG. 7B is the enlarged view of one end of FIG. 7.

On the sole side there are several angle caves 14, which are designed for the L-shaped angles. So that the position, number and size of the angle-cuts 10 on the binding, welt or side element 5 and the angle caves 14 on the sole side be coincided with each other, as shown in FIG. 5. The binding, welt or side element 5, the L-shaped angle 3 and angle cave 14 are shown in details in FIG. 7, FIG. 7A (assembly) and FIG. 7B.

Figure 9:
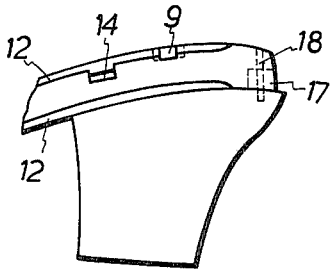
FIG. 9 shows the angle cave, the fastening-cut and the block-cave on the rear part of the sole.

At both ends of the binding, welt or side element 5, a block shape end portion (block) 15 with a hole 16 at its center is prepared. At the rear end of the sole 2, there is another block-cave 17 for the blocks 15. There are two holes 18 through the block indentation (block-cave) 17 on the sole 2 to go with the other two holes 16 on both ends of the binding, welt or side element 5. The holes 18 are threaded when they reach the bottom of the block-cave 17, as shown in FIGS. 5 and 9.

After the L-shaped angles 3 on the vamp 1 are inserted into the angle-caves 14, then the vamp 1 now hooks the sole 2 firmly, the fasteners 8 can be put in the fastening-cuts 9, then the fasteners 8 are now in the fastened position. So the binding, welt or side element 5 can be further fastened by locking both ends of the binding, welt or side element 5 in the block-cave 17 by two screws 19 through the holes 16 and half-threaded holes 18, as shown in FIGS. 1 and 9. Now the vamp 1 of the sandal is firmly joined to the sole 2, so that the sandal is ready to wear.

Figure 4:
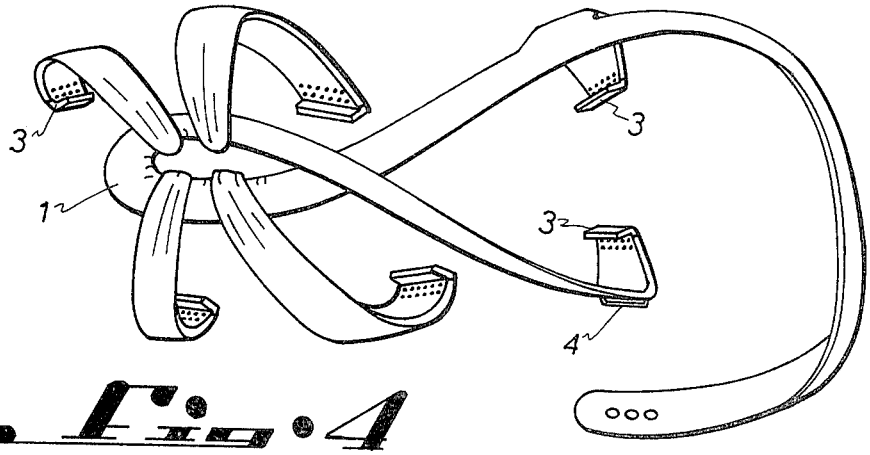
FIG. 4 shows a different type of vamp whose front part and rear part are made in one piece.

The sandal, as shown in FIG. 1, can be completely changed to a new sandal by changing the shoelace 5 to another binding, welt or side element 5 with different colour, type, etc. and by changing the vamp with different colour, type, etc. as shown in FIG. 4.

The present invented sandal can be used in many different occasions, such as on a trip, the man (or lady) can carry a few different bindings, welts or side elements 5 and vamps 1, he can wear a pair of new sandals anytime only by changing the binding, welt or side element 5 and/or vamp 1 he (or she) carried. Since the volume of the binding, welt or side element 5 and vamp 1 after packed is very small, he (or she) can carry the binding, welt or side element 5 and vamps 1 as many as he (or she) desired.

I claim:

1. A sandal formed of attachable elements which are individually replaceable comprising:

a binding element having an inside surface and a plurality of fasteners on said inside surface and having two end portions;

a vamp having opposed L-shaped ends, each of said ends having a base and vertical portion;

a sole having a heel portion and having a plurality of cut-out fastening regions and a plurality of angular indentations in the side thereof, each of said fastening regions corresponding to one of said fasteners, each of said fastening regions being adapted to receive therein said corresponding fastener, each of said indentations corresponding to one of said L-shaped ends, each of said indentations being adapted to receive therein the base portion of said corresponding L-shaped end, the vertical portion of said L-shaped end abutting said side of said sole;

said binding element surrounding and molding to said side of said sole, holding said base portion of each said L-shaped ends fitting in said corresponding indentation and holding said vertical portion of each said L-shaped end abutting the side of said sole, thereby detachably joining said sole, vamp and binding element; and means for detachably locking the heel portion of said sole to said binding element end portions.

2. A sandal as in claim 1 wherein:

said sole side comprises a protruding stripe along the middle part thereof;

said binding element having at least one protruding stripe having said binding element fasteners extending therefrom, said stripe and said fasteners being shaped to mold to said sole side in said fastening regions; and said at least one binding element stripe and said sole stripe extending only from one side of the heel portion of said sole around the front side of said sole to the other side of the heel portion of said sole.

3. A sandal as in claim 2 wherein said at least one binding element stripe has greater extension at its portion adjacent to the front of said sole than at the remaining portions thereof.

4. A sandal as claim 1 wherein:

said binding element includes block shape end portions;

said sole side heel portion comprises a sole side heel portion having two block indentations, each of said block indentations corresponding to one of said block shape end portions and shaped to be received therein; and said detachable fixing means includes means for locking said block shape end portions into said block indentations when said vamp, sole and binding element are in the assembled state.

5. A sandal as in claim 1 wherein said binding element comprises a monolithic binding element.

6. A sandal as in claim 2 wherein:

said binding element includes block shape end portions;

said sole side heel portion comprises a sole side heel portion having two block indentations, each of said block indentations corresponding to one of said block shape end portions and shaped to be received therein; and said detachable fixing means includes means for locking said block shape end portions into said block indentations when said vamp, sole and binding element are in the assembled state.

* * * * *